United States Patent [19]

Volk, Jr.

[11] 3,970,823

[45] July 20, 1976

[54] ELECTRIC HEATER

[75] Inventor: Joseph A. Volk, Jr., Florissant, Mo.

[73] Assignee: Beta Corporation of St. Louis, Bridgeton, Mo.

[22] Filed: Dec. 5, 1974

[21] Appl. No.: 529,755

[52] U.S. Cl. ..... 219/546; 21/102 R; 219/432; 219/528; 219/535; 338/218

[51] Int. Cl.[2] ..... H05B 3/02

[58] Field of Search ..... 219/211, 212, 417, 432, 219/436, 437, 438, 433, 521, 523, 528, 530, 535, 546, 552; 338/141, 217, 218, 296; 21/54, 82, 85, 92, 102 R; 264/328; 195/119

[56] References Cited

UNITED STATES PATENTS

| | | | |
|---|---|---|---|
| 1,817,027 | 8/1931 | Anderson | 338/218 X |
| 1,881,881 | 10/1932 | Noble | 338/218 X |
| 1,992,593 | 2/1935 | Whitney | 219/535 X |
| 2,473,402 | 6/1949 | Wood | 219/417 X |
| 2,766,367 | 10/1956 | Chaustowich | 219/523 |
| 3,304,408 | 2/1967 | Finch et al. | 219/544 |
| 3,393,297 | 7/1968 | Hart | 219/528 |
| 3,436,171 | 4/1969 | Weichselbaum | 21/85 |
| 3,602,692 | 8/1971 | Morey | 219/535 |
| 3,806,701 | 4/1974 | Scott | 219/438 |

*Primary Examiner*—Volodymyr Y. Mayewsky
*Attorney, Agent, or Firm*—Rogers, Eilers & Howell

[57] ABSTRACT

An electric heater having a ceramic core with a heating element surrounding the core and a jacket surrounding the heating element such that the heating element is secured to the jacket but there is no chemical bonding between the heating element and the core. In the method of producing the electric heater, the core is formed in an uncured state and then surrounded with the heating element. The heating element is surrounded by a jacket such that the heating element is secured to the jacket, and the core is thereafter cured.

In producing an article such as the core of the heater from a thermosetting type material, the material is preheated to within a range so as to soften the material sufficiently for injection into a mold. The mold is preheated to a temperature sufficient to cure the material after injection into the mold. The material is then injected into the mold and the injection pressure thereafter released while keeping the mold clamped together for a time after release of the injection pressure, and thereafter the mold is unclamped and the article is removed from the mold.

4 Claims, 8 Drawing Figures

FIG. 1.
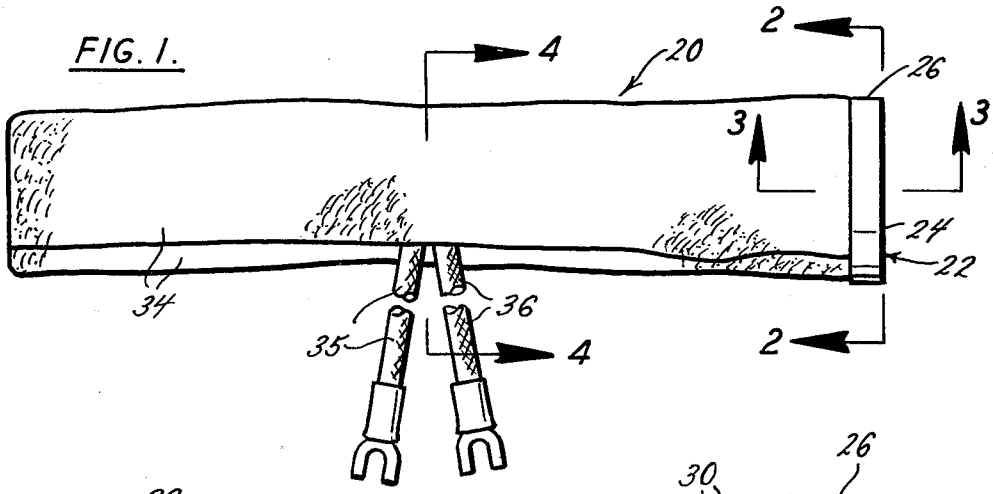
FIG. 2.
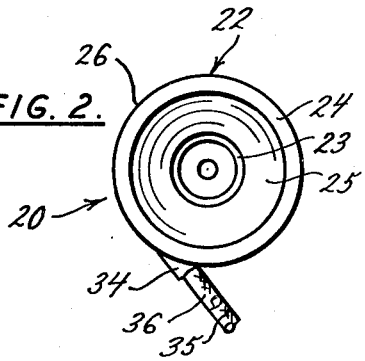
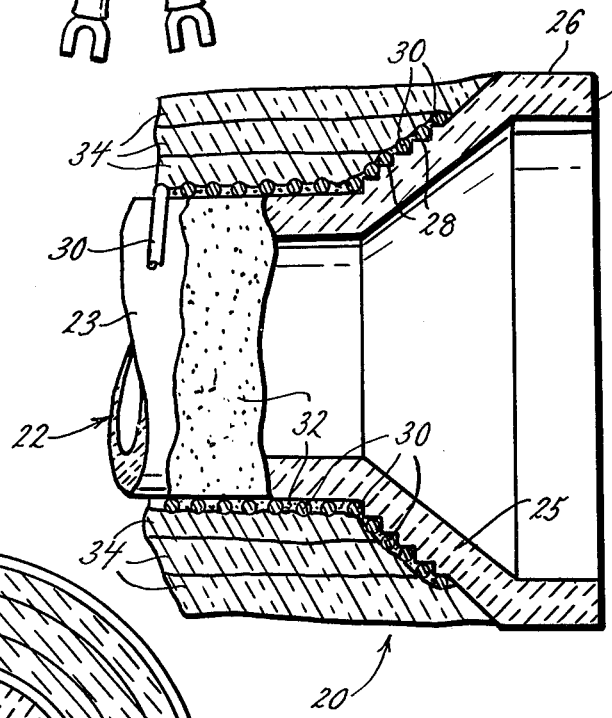
FIG. 3.
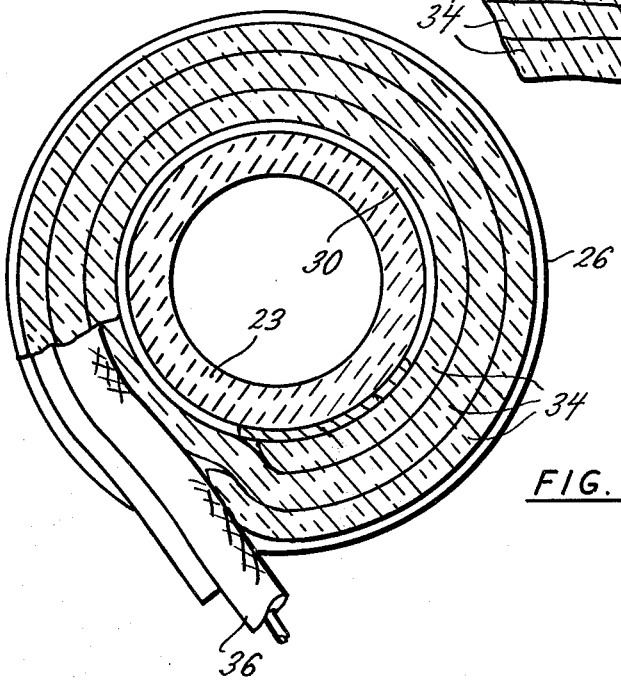
FIG. 4.

FIG. 6.
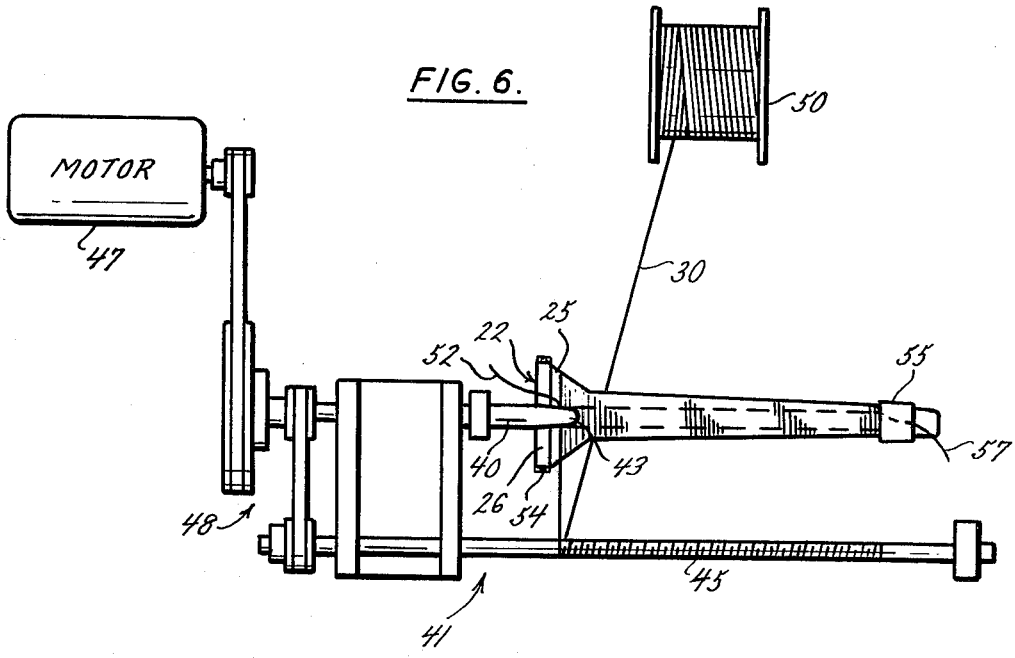
FIG. 7.
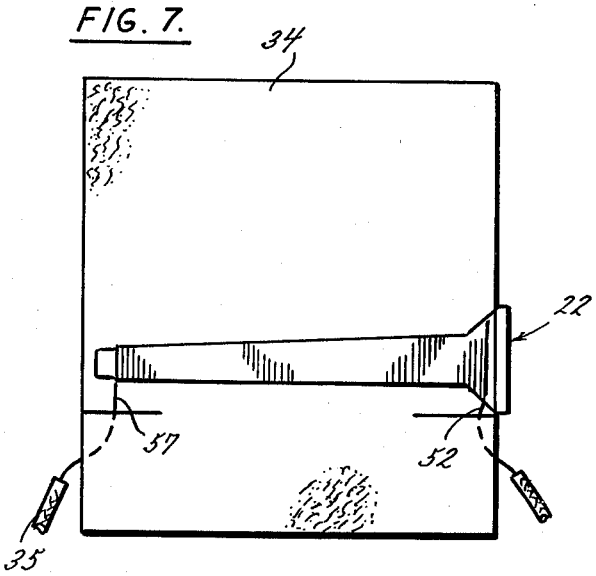
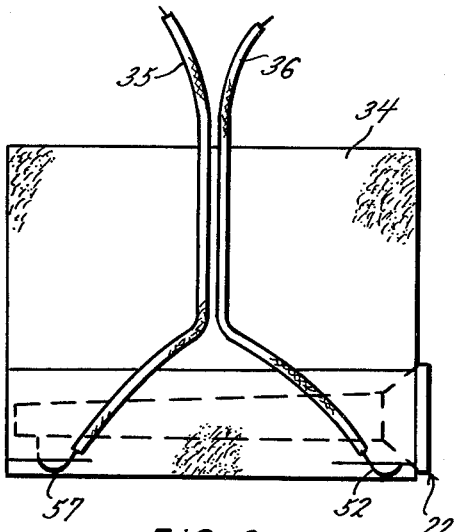
FIG. 8.
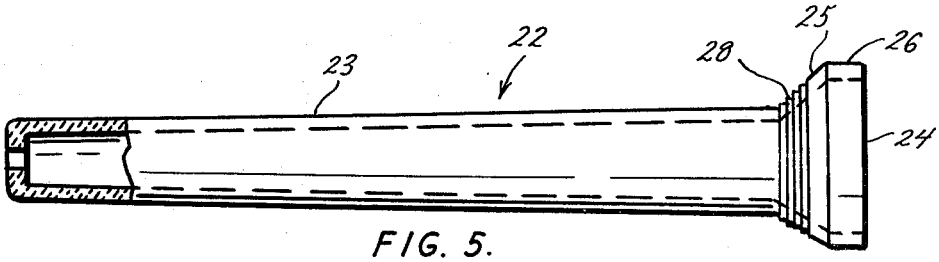
FIG. 5.

ELECTRIC HEATER

BACKGROUND OF THE INVENTION

This invention relates to an electric heater and, specifically of a type for producing a relatively high heat concentration in a small volume useful for the quick sterilization of probes and the like. For example, such electric heaters may be found in medical laboratories where probes and the like are used for handling test specimens and must be sterilized periodically.

By way of background, electric heaters of this general type comprise a core made of a ceramic material that is first machined to the desired shape, and then fired or cured. The core has a shank portion of constant cross section and an enlarged neck portion, generally funnel shaped, for ease in inserting a probe or the like therein for sterilization. A wire type heating element is wound around a portion of the neck at the location of external threads formed thereon, and also along a substantial portion of the shank. A cement having high temperature and good bonding characteristics is coated over the heating element, and an outer covering of felt also having high temperature characteristics is wrapped around the cement. Electrical leads are provided for applying electrical power to the heating element.

The procedure in making the prior art heaters was to first machine the core to the proper shape and dimensions, and then fire or cure it. Thereafter, the heating wire was wound onto the core, a coating of cement applied over the wire which bonded the wire to the core, and the felt covering than wrapped over the cement, such that the cement bonded the felt covering, wire and core together.

While these prior art heaters were operable to an extent, they were possessed with certain problems. One such problem was that the heating element, and thus the heater, failed sooner than was acceptable. This is believed to have been due to expansion and contraction of the core upon energizing and deenergizing the heating element which, because the heating element was bonded to the core, in turn caused expansion and contraction of the heating element and finally its failure.

Another problem with the prior art heaters was that the core had relatively high leakage characteristics so that the user would often receive an electrical shock if the probe he was sterilizing and holding in his hand touched the inner surface of the core. With heaters of this type that operated at the higher voltages, such as 240 volts, the shock was more severe and quite dangerous.

This invention, including the heater and method of making same, has overcome these problems to provide a heater that has exceptionally long life, exceptionally low leakage characteristics, and is of generally higher quality than the electric heaters of this type found in the prior art.

Summary of the Invention

The heater of this invention generally comprises a molded ceramic core made from a material having high temperature and low leakage characteristics. The core has a tapered shank portion with an enlarged neck portion at one end. An electric heating element surrounds a portion of the core and a jacket covers the heating element. The jacket generally comprises an outer layer of high temperature felt insulation which is bonded to the heating element by a layer of cement therebetween. It is an important feature of this invention that there is an absence of chemical bonding between the heating element and the core. In a preferred embodiment of the invention the heating element is a wire which is wound on an externally tapered surface of the neck portion and along a length of the tapered shank. Suitable leads are provided for connecting a source of electrical power to the heating element.

In the method of this invention for producing the heating element, a suitable moldable ceramic material having the requisite high temperature and low leakage characteristics, as well as sufficient strength when cured, is injected into a mold for producing the core of the required size and configuration. A heating element, preferably in the form of a heating wire, is wound onto the core after the core is molded but prior to curing or firing the core. Thereafter, a coating of cement characterized as having high temperature and good bonding characteristics is applied over the heater winding, and a high temperature insulation felt is wrapped over the cement wherein suitable slots are provided for allowing the passage of electrical leads therethrough for connection to the heating element and for applying electrical power to the heater. Next, the core is cured by generally applying increased amounts of heat to it over a period of time so as to change the core from a plastic to a ceramic state.

It is a primary feature of this method of the invention that the heating wire is wound onto the core prior to curing, for it is found that when this sequence is followed, the life of the heater is greatly improved.

It has also been found that the proper selection of material for the core can greatly improve the leakage characteristics, and thus resistance to electrical shock, of the heater. It has been found that a ceramic molding compound is preferable. Such compounds are preferably of the thermosetting type which contain a silicone binder and which are set in a plastic state by the application of a certain amount of heat and later cured to a ceramic state by the gradual application of increased amounts of heat over time. An example of such a compound is Dow-Corning QM-9-1113.

While this material has been found to have the desirable characteristics for the core of the heater of this invention, it has been found that a unique molding process is required to produce cores of the high quality required. Hence, in accordance with the process of this invention for molding this type of material, a quantity of the material is preheated to within a temperature range causing it to soften or become somewhat liquid, so that the material can be injected under pressure under a suitable mold. The mold has male and female portions held together by clamping means or the like and is preheated to a temperature sufficient to set the injected material.

The preheated material is injected into the preheated mold under appropriate pressure. The injection pressure is maintained for a time after the material is fully injected, at which time the injection pressure is released but the mold held clamped together for an additional period of time after releasing the pressure. Thereafter, the mold is removed from the molding machine and unclamped while heat continues to be applied to the mold for a length of time after releasing the clamp to firmly set the material. Finally, the mold portions are separated and the part removed from the mold.

This sequence of steps, which will be hereinafter described in more detail, has been found to be effective in the production of high quality parts made from the above-referenced material.

Thus, it is an object of this invention to provide an improved heater greatly improved life and leakage characteristics.

It is another object of this invention to provide an improved method of producing such a heater.

It is a further object of this invention to provide a process for molding a silicone ceramic molding compound of the above type for the production of high quality parts therefrom.

These and other objects of the invention will become apparent from the drawing and detailed description to follow.

Description of the Drawings

FIG. 1 is a side elevation view of an electric heater of this invention;

FIG. 2 is a view in section taken generally along the line 2—2 of FIG. 1;

FIG. 3 is an enlarged view in section taken generally along the line 3—3 of FIG. 1;

FIG. 4 is an enlarged view in section taken generally along the line 4—4 of FIG. 1;

FIG. 5 is a side elevation view in partial section of the core used in the electric heater of FIG. 1;

FIG. 6 illustrates generally the apparatus and method used for winding heater wire onto the core of FIG. 5; and FIGS. 7 and 8 illustrate the step of wrapping the wire wound core with a covering.

Detailed Description of a Preferred Embodiment

Referring to FIGS. 1 through 5 of the drawing, there is shown an electric heater 20 of this invention, comprising a core 22 having a tapered shank 23 with an enlarged neck portion 24 formed at one end. The neck portion 24 has a tapered section 25 extending from an end ring portion 26 to the largest end of the shank 23. External threads 28 are formed on part of the tapered neck portion 25 and extend to the enlarged end of the shank 23. The purpose of the threads 28 is to hold a heating element wire as will be explained.

The core 22 is hollow and is of relatively thin walled construction, for example, approximately 0.040 of an inch, for greater heat transfer as will be explained. The core is made from a material that withstands high temperature, in this preferred embodiment up to approximately 1800°F., is a good conductor of heat, and has low electrical current leakage characteristics. In a particularly preferred embodiment of the invention, a moldable ceramic compound having a silicone binder is used. An example of such a material is Dow-Corning QM-9-1113. The core 22 is molded from such a material by an injection process and later cured to a ceramic state as will be more clearly described.

A heating element 30, in the form of a heater wire, is wound onto the threads 28 and along the shank 23 of the core 22. The wire 30 is of any suitable type, it exact characteristics such as gauge and the like, and the number of turns wound onto the core, depending on the voltage requirements of the heater.

A layer of cement 32 is applied over the heater wire 30, the cement being of a type capable of withstanding temperatures produced during operation of the heater, in this embodiment as much as approximately 1800°F., having good bonding characteristics, and such as not to attack the heating element. An example of such a cement is No. 8 Sauereisen cement.

Surrounding the cement layer 32 is a jacket or covering 34 of felt insulation. In this preferred embodiment, it too should have temperature characteristics sufficiently high to withstand temperature of over 1800°F. and should also possess good heat insulation characteristics so as to hold the heat generated by the element 30 to within the hollow core 22. An example of such of covering material is a ceramic fiber insulation made by Carborundum and identified by the name Fiberfax.

Also provided are leads 35 and 36 of high temperature wire extending through the covering 34 to connect opposite ends of the heating element 30 to a suitable source of electrical power.

It is an important feature of this invention that the cement 32 bonds the wire heating element 30 to the covering 34, but does not bond the heating element to the core 22. Thus, with the core 22 in place within the covering 34, the heating element 30 is in contact with the tapered neck portion 25 and shank 23, but is not chemically bonded to it. In this described embodiment of the invention, the core 22 may actually be removed by sliding it out the large end of the covering with the heating wire 30 left embedded in the cement layer 32 and bonded by the cement layer to the covering 34. Since there is no bonding of the heating element to the core, expansion and contraction of the core upon energizing and deenergizing the heater, does not cause a corresponding expansion and contraction of the heater wire which is believed to be a major cause of failure of the heater wire in prior art heaters of this type. Also, the use of the preferred core material as described above, provides the core with very low leakage characteristics to greatly reduce electrical shock to the user.

The method of this invention for producing the heater 20 will not be described.

After the core material is molded and set to its plastic state to form the core 22, a procedure that will be more fully described, the heater wire 30 is wound onto the threads 28 of the neck portion 25 and along the tapered shank 23 by means of an apparatus of the type shown schematically in FIG. 6.

Thus, in FIG. 6 there is shown a spindle 40 on which the enlarged neck portion of the core 22 is mounted, the spindle 40 being rotatably mounted on the support structure 41. A clamping device 43 holds the core 22 in immovable relationship relative to the spindle 40.

Also rotatably mounted to the support structure 41 is a lead screw 45. Both the spindle 40 and lead screw 45 are driven by means of a variable speed motor 47 and pulley arrangement 48, as shown. Suitable controls, such as a foot pedal or the like (not shown) are provided for controlling the speed of the motor and thus the speeds of the spindle 40 and lead screw 45.

A spool 50 of heating element wire is mounted in a manner commonly known in the art, and the wire is fed over the lead screw 45 and into the thread of the threaded neck portion 25 nearest the large end of the core 22. The end of the wire is angled from this thread under the clamp 43 and past the enlarged end of the core, leaving a pigtail 52 of suitable length. Tape 54 is used to further secure the pigtail 52 to the enlarged end of the core. With the wire so positioned, the motor 47 is operated to drive the spindle 40 and feed screw 45 in a direction to wind the wire on the threads 28 and along the tapered shank 23 of the core as it moves along the lead screw 45. The wire is wound onto the shank for a length depending on the voltage requirements of the heater. When the wire is wound the proper length, the other end is taped as shown at 55 and the wire cut to leave a pigtail 57 of suitable length.

The wound core is then removed from the spindle 40 and a coating of cement, of a type heretofore described, is applied over the wire. After the cement had dried, wire leads 35 and 36 are then connected to the pigtails 57 and 52, such as with crimped type connectors, and the felt covering 34 is wrapped around the cemented core, the pigtails 57 and 52, and portions of the leads 35 and 36, such that end portions of the leads 35 and 36 extend outwardly therefrom for connection to a suitable source of electric power.

After the core has been wound, cemented, and wrapped, clamps are placed around the wrapping 34 to hold it in place while the wrap dries.

To cure the core the leads 35 and 36 are connected to a suitable source of supply and a gradually increasing voltage is applied to the heating element until fully rated voltage is reached. In this manner, the temperature of the core is increased very slowly over time until it finally reaches its ceramic state. As the core is heated during curing, gases are given off which must be allowed to escape. If the core is heated too quickly during curing, the heated gasses trapped and produce fractures in the core. With the Dow-Corning QM-9-1113 material described above, it has been found that proper curing is obtained where the temperature of the core is steadily increased from room temperature to approximately 1100° F. in a 24-hour period. At the end of the 24-hour period, full rated voltage is applied to the heating element to raise the core temperature to the fully operating temperature of 1600° F. in approximately 15 minutes. Full voltage is applied for approximately another 1½ hours to fully cure the core.

It is a primary feature of this invention that the core is cured after the heating wire is wound onto the core. During the curing process, the core loosens from the cement 32 and wire 30, while the wire remains embedded and bonded into the cement. This is believed to be caused by a combination of shrinkage and the leaching action of the core material, and is believed to be aided by the tapered shape of the core. Thus, after curing, the core is no longer chemically bonded to the wire and, in fact, can be easily removed by simply sliding it out the enlarged end of the jacket. The advantages achieved thereby are quite significant, for while with the prior art beaters of this type expansion and contraction of the core during normal operation of the heater produced expansion and contraction of the wire heating element and finally breakage or failure of the element, with the heater and method of this invention such expansion and contraction of the core does not produce a corresponding effect on the wire heating element since it is not bonded thereto, with the result that the life of the heater is greatly increased.

The process for molding the core 22 will now be described. It has been found that there are certain critical steps in molding high quality parts from the material described above as being a moldable ceramic having a silicone binder, and particularly Dow-Corning QM-9-1113. While parts can be produced by simply injecting the material under pressure into a suitable mold at the proper injection and setting temperatures, the resultant parts are often poor quality, and characterized as having rough surfaces, scratches, poor strength, fractures or nonuniformity of material. Hence, there are certain steps which are critical in the molding process for producing high quality parts.

In the preferred molding method of this invention, a quantity of the material sufficient to produce the parts to be molded is placed into the injection nozzle of a suitable injection molding machine where it is preheated to a temperature sufficient to make the material liquid of flowable under the injection pressure of the machine. A suitable mold having male and female portions is provided for receiving the injected material and for producing the desired parts. The mold is preheated to a temperature sufficient to produce setting of the material after injection into the mold. These temperatures may be easily determined for a given material, and for the Dow-Corning material described above, and the particular core configuration of the core 22, these temperatures are approximately 160° F. and 500° F., respectively.

With the male and female portions of the mold firmly clamped together and properly positioned in the molding machine, the preheated material is injected under suitable pressure into the mold. After injection of the material into the mold, the material begins to expand, and it has been found desirable in producing high quality parts to maintain the injection pressure for a period of time after initial injection of the material into the mold until expansion of the material is substantially completed. In this preferred embodiment of the invention, it has been found that the injection pressure should be maintained for approximately 30 seconds. After release of the injection pressure, the mold should continue to be heated at the setting temperature and should remain clamped for an additional period of time after release of the pressure. In this preferred embodiment in making the core 22, it has been found that the mold should be kept clamped for an additional 30 seconds after release of the pressure. After this period, the mold is unclamped, removed from the molding machine, and heated at the setting temperature for a period sufficient to complete the setting of the material. In this preferred embodiment, it has been found that the mold should be heated an additional 2 minutes after unclamping the mold sections. Finally, the part is removed from the mold.

An important step in this process for producing high quality parts is not only to hold the injection pressure for a finite period of time until expansion of the material in the mold is substantially completed, but also to hold the mold clamped for a finite period of time after releasing the injection pressure and while continuing to apply sufficient heat to produce further setting of the material within the mold.

Although it is not completely known what occurs within the material while the mold sections are clamped together and after the injection pressure is released, it is believed that the clamped mold prevents an expansion of the material while it is setting that would otherwise weaken its molecular bond and produce parts of inferior strength.

For example, cores 22 were molded using the above recited parameters except the mold was not held clamped a sufficient time after release of the injection pressure. The result was that 95–98% of the parts were rejected for poor quality. They were characterized as having fractures, discolorations, poor finish, insufficient strength, or they would rupture during curing.

Thus, there has been described an improved heater having exceptionally long life and low leakage characteristics, and an improved method of producing same.

Various changes and modifications may be made within this invention as will be readily apparent to those skilled in the art. Such changes and modifications are within the scope and teaching of this invention as defined by the claims appended hereto.

What I claim is:

1. A heater comprising a rigid, substantial hollow core of heat conductive material, said core having an elongated tapered shank and an enlarged neck portion at the large end of the shank said core being open at the end where the enlarged neck portion is located said neck portion having an externally threaded portion that tapers into the shank, a jacket of electrical and heat insulating material surrounding the core, the inside surface of said jacket being of the same taper as the shank and externally threaded neck portion, an electrical heating element coil secured to the inside surface of said jacket, said element coil following the threads of the externally threaded neck portion and along the shank of said core, and being contiguous therewith, there being a substantial freedom of attachment between said heating element and said core.

2. The heater of claim 1 wherein the heating element is secured to the jacket by means of a layer of cement which bonds the heating element to said jacket.

3. The heater of claim 1 wherein the core is made of a cured moldable ceramic.

4. The heater of claim 1 wherein the core is removable from said heating element and jacket without damaging said element.

* * * * *